US006116951A

United States Patent [19]

Shu

[11] Patent Number: 6,116,951

[45] Date of Patent: Sep. 12, 2000

[54] CLIP WIRE STRUCTURE OF THE LAMP STRING

[76] Inventor: Kuo Fen Shu, No. 10, Lane 198, Chung Cheng Road, Chinchu, Taiwan

[21] Appl. No.: 09/321,106

[22] Filed: May 27, 1999

[51] Int. Cl.[7] ..... H01R 13/60

[52] U.S. Cl. ..... 439/574; 439/575

[58] Field of Search ..... 439/574, 575, 439/449, 448, 447, 456, 460; 362/238, 249, 226, 391

[56] References Cited

U.S. PATENT DOCUMENTS 2,229,403 1/1941 Benander ..... 439/575
5,584,567 12/1996 Rumpel ..... 439/575
5,941,628 8/1999 Chang ..... 439/575

*Primary Examiner*—Renee Luebke
*Assistant Examiner*—Antoine Ngandjui
*Attorney, Agent, or Firm*—Rosenberg, Klein & Lee

[57] ABSTRACT

The present invention relates to a clip wire structure of the lamp string, which mainly mounts a connecting seat in the exterior of a lamp socket to provide simple and easy sleeve-fit with an engaged block. It can simultaneously clamp the electrical wires tightly between the connecting seat and engaged block, such that the lamp socket can be attached to the electrical wires to achieve the clip-fixing effect of the lamp string and electrical wires. And it can form a lamp string structure which provides for the decorative usage, thus becomes the one With the advantages of practical effects and raising value.

7 Claims, 6 Drawing Sheets

CLIP WIRE STRUCTURE OF THE LAMP STRING

BACKGROUND OF THE INVENTION

Conventionally, in order to create the special decorative effect of a net lamp string, clip-assembled ears are mounted in the exterior of the lamp socket to clip-assemble with the electrical wires. The said conventional structure of the clip-assembled ears is a flexible hooked body. Although, it can simply and easily clip with the electrical wires, it is unable to fix-set a lamp set effectively on the electrical wires. Therefore, while hanging, there are situations that their relative positions usually have loosened or the clip-assembly has fallen off. Their assembling strength is not strong enough to achieve the purpose of practical usage.

OBJECT OF THE INVENTION

Owing to this, the main object of the present invention is to provide a clip wire structure of the lamp string. It can firmly assemble the electrical wires with the lamp socket, with better strength and without arousing the disadvantage of falling off. Now, by fitting with the drawings, the structure and features of the present invention are described as the following:

DETAILED DESCRIPTION OF THE INVENTION

Figure 1:
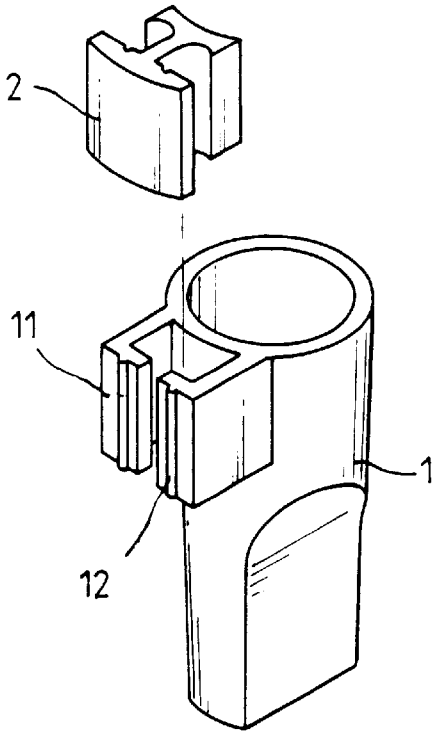
FIG. 1 is an exploded three dimensional diagram of the present invention.
Figure 2:
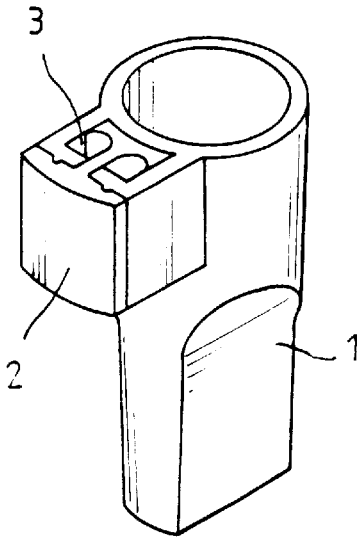
FIG. 2 is an assembled three dimensional diagram of the present invention.

Please refer to those shown in FIGS. 1, 2, the characteristic of the present invention mainly is to mount a connecting seat(11) formed by a pair of opposed L-shaped blocks in each side of every lamp sockets (1) of the lamp set of lamp string, which include a engagement block (2) with I-shaped section. The said engagement block (2) can be sleeve-fitted in the connecting seat (11) to be clipped together, such that it forms two independent voids (3) between them. In the present embodiment, the external end surface of connecting seat (11) is set with two engaged protruding ribs (12), and the relative inner side edges of the exterior of engagement blocks (2) are set with concave grooves (21). While these two are assembled, the protruding ribs (12) just align with the concave grooves (21), thus the connecting seat (11) assembled by these two L-shaped blocks just is clip-controlled to enhance the clipping strength.

Figure 3:
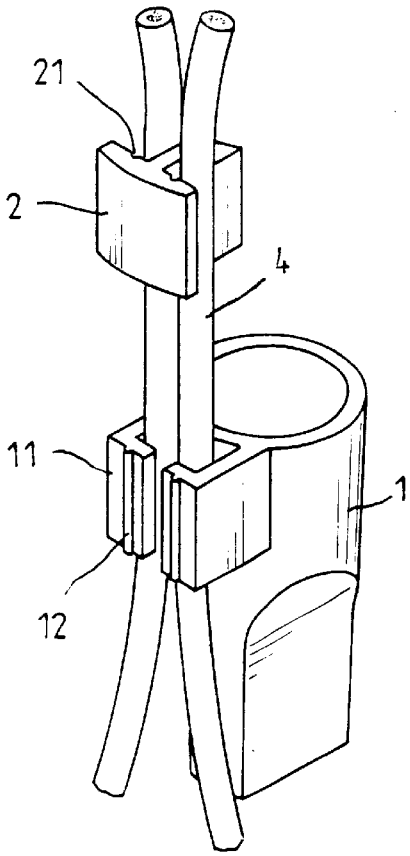
FIG. 3 is a three dimensional diagram of FIG. 1 while sleeve-fitted with electrical wires.
Figure 4:
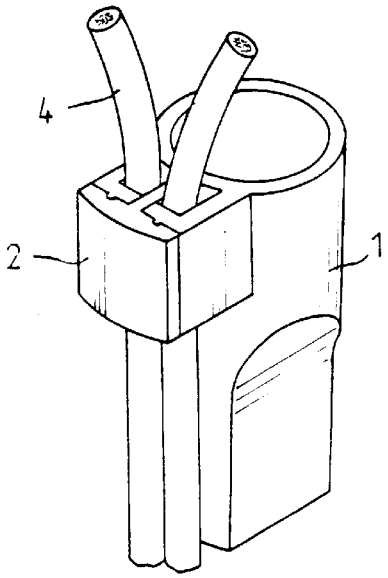
FIG. 4 is a three dimensional diagram of FIG. 2 while sleeve-fitted with electrical wires.
Figure 5:
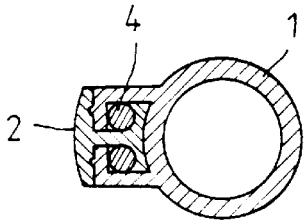
FIG. 5 is a sectional diagram of FIG. 4.

While using as in FIGS. 3 and 5, the electrical wires (4) just pass through and locate within two voids (3). And, it can provide to form a firmly fixed clip-assembly between each lamp socket (1) of the lamp set of lamp string with electrical wires (4) under the status of effective clip-assembly of connecting seat (11) and engagement block (2), thus to obtain the expected effects.

Figure 6:
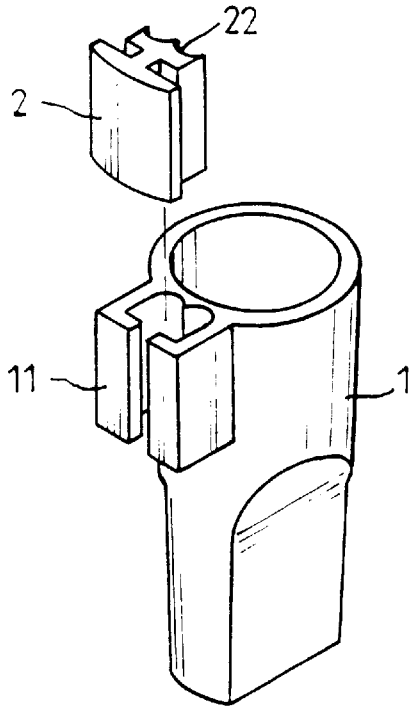
FIG. 6 is an exploded three dimensional diagram of a second example of the present invention.
Figure 7:
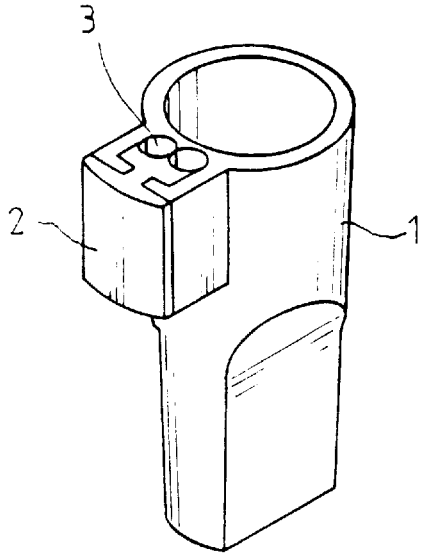
FIG. 7 is an assembled three dimensional diagram of FIG. 6.

As those shown in FIG. 6, FIG. 7, they are the diagrams of varied examples of changing basic assembled structures between the engagement block (2) and connecting seat (11). Wherein the inner side of engagement block (2) is formed as an arched surface (22), such that the voids (3) of assembled electrical wires are located at the inner sides to clip the electrical wires.

Figure 8:
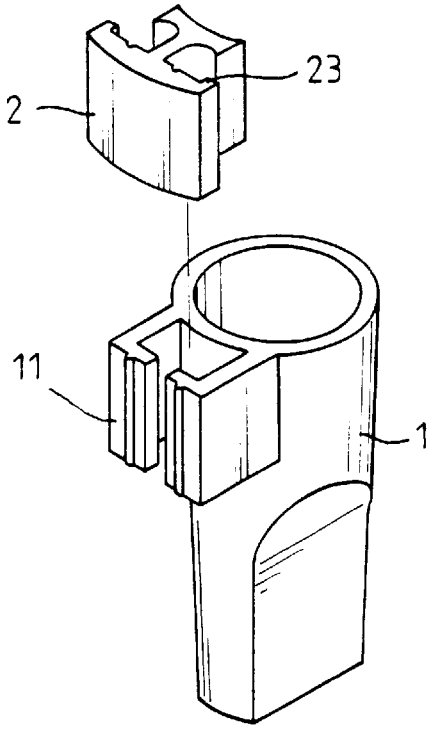
FIG. 8 is an exploded three dimensional diagram of a third example of the present invention.
Figure 9:
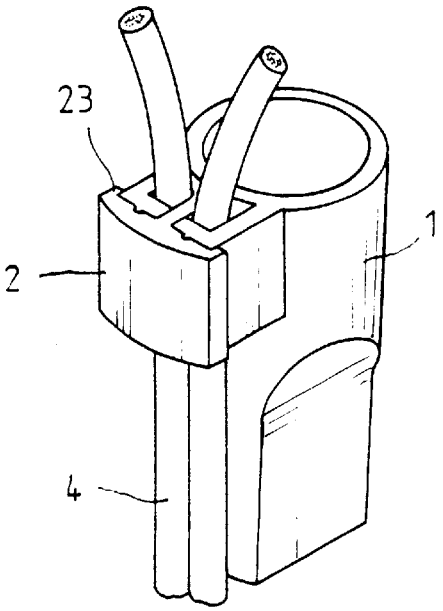
FIG. 9 is an assembled three dimensional diagram of FIG. 8 while sleeve-fitted with electrical wires.
Figure 10:
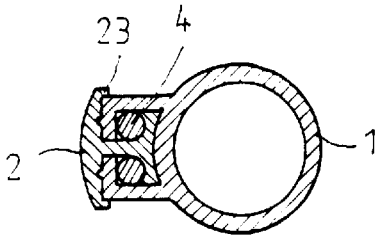
FIG. 10 is a sectional diagram of FIG. 9.

Please refer to FIG. 8 to FIG. 10 which shows another example of the present invention, it mainly mounts a bending portion (23) in two external ends of engagement block (2) to strengthen the clip assembly of connecting seat (11) with L-shaped blocks. Thus it can obtain the optimum assembly strength and prevent the falling off the electrical wires (4) and lamp socket (11) effectively.

Figure 11:
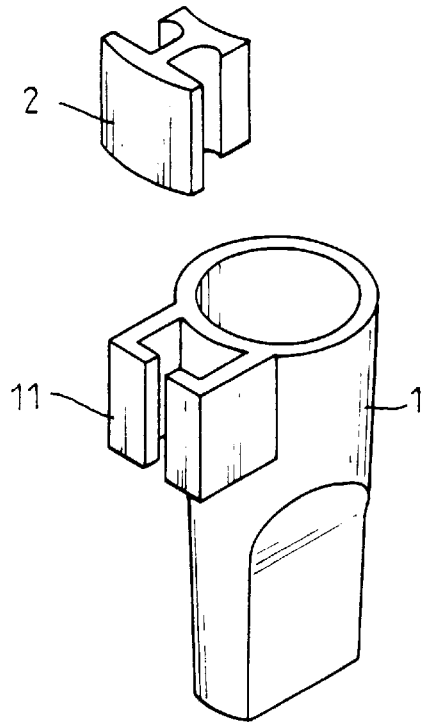
FIG. 11 is an exploded three dimensional diagram of a fourth example of the present invention.
Figure 12:
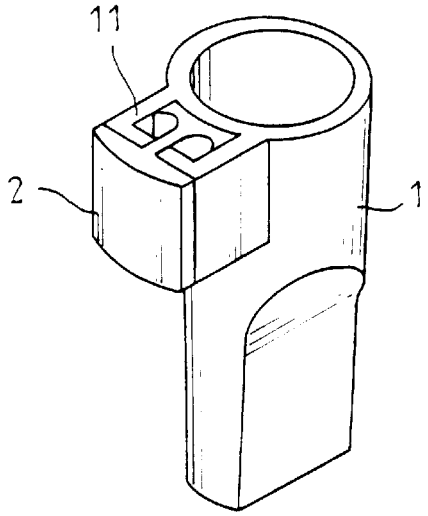
FIG. 12 is an assembled three dimensional diagram of FIG. 11.

Those shown in FIG. 11, FIG. 12 are the simplified structures or examples of the present invention, wherein the external edge surface of two L-shaped blocks and the external inner edge surface of engagement block (2) are planar structures which contacts with each other.

Figure 13:
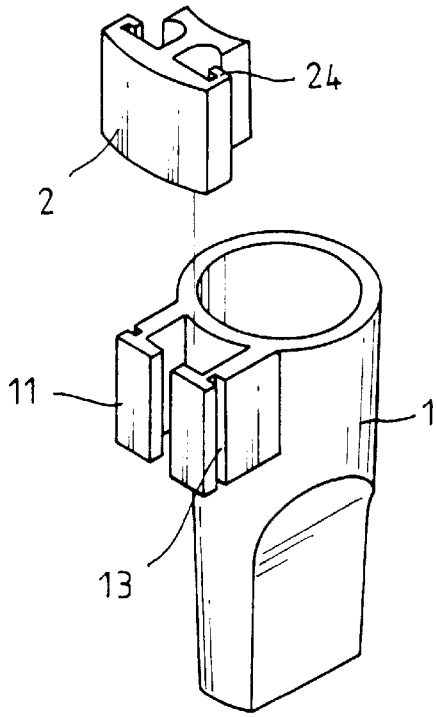
FIG. 13 is an exploded three dimensional diagram of a fifth example of the present invention.
Figure 14:
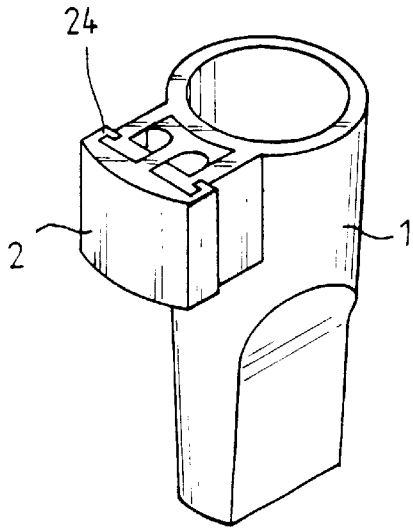
FIG. 14 is an assembled three dimensional diagram of FIG. 13.

The varied examples shown as FIG. 13 to FIG. 14 mainly is to mount the clip-assembled groove (13) in the front portions of two sides of L-shaped block of the connecting seat, and mount the double-bent flange portions (24) in each external end of engagement block (2). Thus, it is able to clip the ends of double-bent flange portions (24) to the concave grooves (13) to obtain the most effective assembly strength. And, while clip-assembling the engagement block (2) with the connecting seat (11) of lamp socket (1), it is able to firmly fix the electrical wires and absolutely without loosening.

By summarizing the above described, the present invention utilizes the subtle fit between the engaged block and connecting socket, thus it can provide the simple and easy clip assembly effects with patent values that the conventional ones can not achieve. However, the above described simply are the examples of the present invention. Any simple improvement within the spirit of the present invention, such as setting the similar structures in two sides of lamp socket, should also be contained in the claims of the present patent.

What is claimed is:

1. A wire clip assembly for securely coupling a lamp socket of a lamp string to a pair of wires comprising:

(a) a lamp socket having an outer wall and a connecting seat extending therefrom, said connecting seat including a pair of block sections spaced one from the other, each said block section having a front portion extending transversely from a side portion to define a substantially L-shaped sectional contour, said front portion of each said block section being offset from said outer wall;

(b) an engagement block slidably coupled to said connecting seat of said socket, said engagement block including external and internal end portions and an intermediate portion extending therebetween to define a substantially I-shaped sectional contour, said external end portion engaging said front portions of said connecting seat block sections to pass said intermediate portion therebetween, said internal end portion being thereby disposed between said front portions of said connecting seat block sections and said outer wall for capturing the wires against said lamp socket;

whereby said lamp socket is securely coupled to the wires for suspension therefrom.

2. The wire clip assembly as recited in claim 1 wherein said front portion of each said connecting seat block section has formed thereon a protruding rib, and said external end portion of said engagement block has formed therein a pair of first grooves respectively engaging said protruding ribs of front portions of said connecting seat block sections.

3. The wire clip assembly as recited in claim 1 wherein said internal end portion of said engagement block has formed thereon an arched surface for substantially conforming capture of the wires against said lamp socket.

4. The wire clip assembly as recited in claim 3 wherein said arched surface is disposed on said engagement block internal end portion to oppose said front portions of said connecting seat block sections.

5. The wire clip assembly as recited in claim 3 wherein said arched surface is disposed on said engagement block internal end portion to oppose said outer wall of said lamp socket.

6. The wire clip assembly as recited in claim 1 wherein said engagement block further includes a pair of double bent flange portions respectively extending from opposing ends of said external end portions to respectively engage said front portions of said connecting seat block sections.

7. The wire clip assembly as recited in claim 6 wherein said side portion of each said connecting seat block section has formed therein adjacent said front portion a second groove for engaging one said double bent flange portion of said engagement block.

* * * * *